United States Patent [19]

Kato et al.

[11] Patent Number: 4,840,865

[45] Date of Patent: Jun. 20, 1989

[54] LIQUID DEVELOPER FOR ELECTROSTATIC PHOTOGRAPHY

[75] Inventors: Eiichi Kato; Shigeyuki Dan; Hiroshi Ishibashi; Kazuo Ishii; Hidefuji Sera, all of Shizuoka, Japan

[73] Assignee: Fuji Photo Film Co., Ltd., Kanagawa, Japan

[21] Appl. No.: 946,728

[22] Filed: Dec. 29, 1986

[30] Foreign Application Priority Data

Dec. 26, 1985 [JP] Japan ..... 60-294550

[51] Int. Cl.[4] ..... G03G 9/12

[52] U.S. Cl. ..... 430/114; 430/115

[58] Field of Search ..... 430/114, 115

[56] References Cited

U.S. PATENT DOCUMENTS

| | | | |
|---|---|---|---|
| 3,883,440 | 5/1985 | Tamai et al. | 252/62.1 |
| 4,081,391 | 3/1978 | Tsubuko et al. | 430/114 |
| 4,156,034 | 5/1979 | Mukoh et al. | 430/116 |
| 4,388,395 | 6/1983 | Tsubuko et al. | 430/114 |
| 4,618,557 | 10/1986 | Dan et al. | 430/114 |

FOREIGN PATENT DOCUMENTS

| | | |
|---|---|---|
| 0155788 | 9/1985 | European Pat. Off. . |
| 2536282 | 1/1977 | Fed. Rep. of Germany . |
| 2700650 | 7/1977 | Fed. Rep. of Germany . |
| 1563240 | 3/1980 | United Kingdom . |

*Primary Examiner*—John L. Goodrow

*Attorney, Agent, or Firm*—Sughrue, Mion, Zinn, Macpeak & Seas

[57] ABSTRACT

A liquid developer for electrostatic photography is disclosed, comprising a non-aqueous solvent having electrical resistivity of not less than $10^9$ Ω.cm and a dielectric constant of not more than 3.5 having dispersed therein at least a resin, wherein said resin is a copolymer resin obtained by subjecting a solution containing (A) at least one of monofunctional monomer which is soluble in said solvent but insolubilized upon polymerization and (B) at least one of monomers having at least two polar groups and/or polar linking groups represented by formula (I):

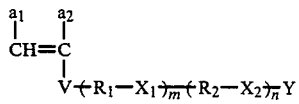

(I)

wherein V, Y, $R_1$, $R_2$, $X_1$, $X_2$, $a_1$, and $a_2$ are defined in the specification, to a polymerization reaction in the presence of a resin which is soluble in said solvent and contains no graft group polymerizable with said monomers. The developer is excellent in dispersion stability, redispersibility and fixing properties and is capable of producing a master plate for offset printing having excellent ink sensitivity and printing durability.

13 Claims, No Drawings

LIQUID DEVELOPER FOR ELECTROSTATIC PHOTOGRAPHY

FIELD OF THE INVENTION

This invention relates to a liquid developer for electrostatic photography comprising a carrier medium having an electrical resistivity of not less than $10^9$ Ω·cm and a dielectric constant of not more than 3.5 having dispersed therein at least one resin. More particularly, this invention relates to a liquid developer for electrostatic photography excellent in redispersibility, preservability, stability, image reproducibility and fixing property.

BACKGROUND OF THE INVENTION

General liquid developers for electrophotography comprise a liquid medium having high insulating properties and low dielectric constants, such as petroleum aliphatic hydrocarbons, having dispersed therein organic or inorganic pigments or dyes, e.g., carbon black, nigrosine, phthalocyanine blue, etc., and natural or synthetic resins, e.g., alkyd resins, acrylic resins, rosine, synthetic rubbers, etc., and further contained therein a polarity regulator, such as metallic soaps, lecithin, linseed oil, higher fatty acids, polymers containing vinylpyrrolidone, etc. In these liquid developers, resins are dispersed as insoluble latex particles having a diameter of from 0.1 μm to several hundreds μm. However, since bonding between soluble resins for dispersion stability or polarity regulators and the insoluble latex particles is insufficient in the conventional developers, the soluble resins and regulators are apt to diffuse into the solution. As a result, the soluble resins for dispersion stability are separated from the insoluble latex particles during long-term preservation or repeated use to cause sedimentation, aggregation or accumulation of the particles or unclear polarity. The aggregated or accumulated particles are scarcely redispersed in the medium so that they adhere to various parts of a developing machine, which leads to stains on image areas or developing machine trouble, such as clogging of a feed pump, and the like.

In order to overcome these disadvantages, it has been proposed to chemically bind the soluble resins for dispersion stability and the insoluble latex particles as disclosed, e.g., in U.S. Pat. No. 3,990,980. The inventors experimentally confirmed that spontaneous sedimentation of particles can be suppressed to some extent by this technique, but such an improvement in dispersion stability is still insufficient in terms of redispersion stability for practical use. More specifically, when these liquid developers are practically used in an actual developing apparatus, toners are adhered to various parts of the apparatus to form a filmy solid, which is difficult to redisperse and ultimately causes the apparatus to malfunction, stains the image, and the like. Further, according to the process of this patent, it is very likely to produce particles of broad size distribution containing a large proportion of coarse particles or poly-dispersed particles having two or more mean particle sizes, and, in order to prepare mono-dispersed particles having a narrow particle size distribution, combinations of dispersion stabilizers used and monomers to be insolubilized are strictly limited. Furthermore, this process finds difficulty in obtaining mono-dispersed particles having a narrow size distribution and a desired mean particle size, only resulting in production of coarse particles of 1 μm or greater or very fine particles of 0.1 μm or even smaller. In addition, the dispersion stabilizers are prepared through complicated and time-consuming steps.

In order to eliminate the above-described problems, European Patent 155788A1 corresponding to Japanese patent application (OPI) No. 179751/85 (the term "OPI" as used herein means "unexamined published application") discloses that a monomer to be insolubilized is copolymerized with a monomer containing a long-chain alkyl moiety to produce insoluble resin particles, thereby improving dispersibility, redispersibility and preservation stability of insoluble particles.

On the other hand, printing of a large number of prints (i.e., more than 5000) by the use of a master plate for offset printing in an electrophotographic system has recently been attempted. In particular, improvements on master plates have made it possible to obtain more than 10,000 large size prints per plate. Further, efforts to shorten the operation time of the electrophotographic printing plate system by rapid processing of the development-fixation step have also been made.

According to the experiments conducted by the inventors, the particles prepared by the technique dislcosed in European Pat. No. 155788A1 were satisfactory in monodispersibility, redispersibility and preservation stability but did not satisfy performance requirements in view of durability on printing large-sized sheets or rapid fixing processing.

SUMMARY OF THE INVENTION

One object of this invention is to solve the above-described problems associated with the conventional liquid developers and to provide a liquid developer excellent in dispersion stability, redispersibility and fixing properties.

Another object of this invention is to provide a liquid developer which makes it possible to produce by electrophotography a master plate for offset printing having excellent ink-sensitivity and printing durability.

A further object of this invention is to provide a liquid developer suitable for use in various electrostatic photography systems or transfer systems.

A still further object of this invention is to provide a liquid developer which can be used in any systems using liquid developers, such as ink jet recording, cathode ray tube recording, and recording of various changes, e.g., pressure change, electrostatic change, etc.

The present invention provides a liquid developer for electrostatic photography comprising a non-aqueous solvent having an electrical resistivity of not less than $10^9$ Ω·cm and a dielectric constant of not more than 3.5 having dispersed therein a resin, wherein said resin is a copolymer resin obtained by subjecting a solution containing (A) at least one monofunctional monomer which is soluble in said solvent but insolubilized upon polymerization and (B) at least one monomer having at least two polar groups and/or polar linking groups represented by formula (I) to a polymerization reaction in the presence of a resin which is soluble in said solvent and contains no graft group polymerizable with monomers.

Formula (I) is represented by:

$$\begin{array}{l} a_1 \quad a_2 \\ | \quad\;\; | \\ CH{=}C \\ \qquad\;\; | \\ \qquad V\!\left(R_1{-}X_1\right)_m\!\left(R_2{-}X_2\right)_n Y \end{array} \qquad \text{(I)}$$

wherein V represents —O—, $$-\overset{O}{\overset{\|}{C}}-O-,\ -O-\overset{O}{\overset{\|}{C}}-,\ -CH_2O-\overset{O}{\overset{\|}{C}}-,$$

$$-SO_2-,\ -CONH-,\ -SO_2NH-,$$

$$-\overset{W}{\overset{|}{C}}ON-\ \text{or}\ -SO_2\overset{W}{\overset{|}{N}}-,$$

wherein W represents a hydrocarbon residue or $\left(R_1-X_1\right)_m\left(R_2-X_2\right)_n-Y$; Y represents a hydrogen atom, a hydrocarbon residue having from 1 to 18 carbon atoms, or a hydrocarbon residue having from 1 to 18 carbon atoms which is substituted with a halogen atom, —OH, —CN, $-NH_2$, —COOH, $-SO_3H$ or $-PO_3H$; $X_1$ and $X_2$ (which may be the same or different) each represents —O—, —S—, —CO—, $-CO_2-$, $$-O-\overset{O}{\overset{\|}{C}}-,\ -SO_2-,\ -\overset{Y_1}{\overset{|}{N}}-,\ -\overset{Y_2}{\overset{|}{C}}ON-,$$

$$-\overset{Y_3}{\overset{|}{N}}CO-,\ -\overset{Y_4}{\overset{|}{N}}SO_2-,\ -SO_2\overset{Y_5}{\overset{|}{N}}-,$$

$-NHCO_2-$ or —NHCONH—, wherein $Y_1$, $Y_2$, $Y_3$, $Y_4$ and $Y_5$ each has the same meaning as Y; $R_1$ and $R_2$ (which may be the same or different) each represents a substituted or unsubstituted hydrocarbon residue having from 1 to 18 carbon atoms which may contain a moiety of $$-\underset{\underset{X_3\left(R_4-X_4\right)_p Y_6}{|}}{CH}-$$

in its main chain, wherein $X_3$ and $X_4$ (which may be the same or different) each has the same meaning as $X_1$ and $X_2$; $R_4$ represents a substituted or unsubstituted hydrocarbon residue having from 1 to 18 carbon atoms; and $Y_6$ has the same meaning as Y; $a_1$ and $a_2$ (which may be the same or different) each represents a hydrogen atom, a hydrocarbon residue, —COOZ, or —COOZ having a hydrocarbon residue attached at the carbonyl, wherein Z represents a hydrogen atom or a substituted or unsubstituted hydrocarbon residue; and m, n and p (which may be the same or different) each represents 0 or an integer of from 1 to 4.

DETAILED DESCRIPTION OF THE INVENTION

The non-aqueous solvent having an electrical resistivity of not less than $10^9$ Ω·cm and a dielectric constant of not more than 3.5 which can be used in the present invention as a carrier medium preferably includes straight chain or branched aliphatic hydrocarbons or halogen-substituted derivatives thereof and mixtures thereof. Specific examples of such solvents are octane, isooctane, decane, isodecane, decalin, nonane, dodecane, isododecane, and branched chain aliphatic hydrocarbons which are commercially available under the trademarks of Isopar E, G, H or L (Exxon Co.), Shellsol 70 or 71 (Shell Oil Co.), Amsco OMS or 460 (American Mineral Spirits Co.), etc.

The insoluble latex particles according to the present invention are prepared by so-called polymerization granulation using soluble resins for dispersion stability. Solvents to be used in the polymerization may be any of those miscible with the above-described carrier medium and include straight chain or branched aliphatic hydrocarbons, alicyclic hydrocarbons, aromatic hydrocarbons, or halogen-substituted derivatives of these hydrocarbons, and mixtures thereof. Specific examples of solvents that may be used are octane, isooctane, decane, isodecane, decalin, nonane, dodecane, isododecane, Isopar E, G, H or L, Shellsol 70 or 71, Amsco OMS or 460, etc.

The non-aqueous dispersion resin which is the most important component in the liquid developer of this invention is prepared by polymerizing monomers in a non-aqueous solvent in the presence of a dispersion stabilizer.

The non-aqueous solvents to be used for the polymerization may essentially be any of those miscible with the above-described carrier medium for the liquid developer but are, in general, preferably selected from the same solvents as enumerated for the carrier media, i.e., straight chain or branched aliphatic hydrocarbons, alicyclic hydrocarbons, aromatic hydrocarbons, halogenated hydrocarbons, and the like. Specific examples of the solvents which can be used preferably include hexane, octane, isooctane, decane, isodecane, nonane, dodecane, isododecane, and isoparaffinic petroleum solvents, e.g., Isopar E, G, H or L, Shellsol 71, Amsco OMS, etc.

The dispersion stabilizers which are required in the polymerization to form a stable resin dispersion of the resulting solvent-insoluble polymer are selected from conventionally known dispersion stabilizers that do not contain any graft group polymerizable with monomers. That is, various kinds of synthetic or natural resins soluble in non-aqueous solvents can be used either individually or in combinations of two or more thereof. Examples of the dispersion stabilizing resins to be used include homo- or copolymers of monomers selected from esters of acrylic acid, methacrylic acid or crotonic acid having an alkyl or alkenyl chain containing from 6 to 32 total carbon atoms which may have substituents (e.g., a halogen atom, a hydroxyl group, an amino group, an alkoxy group, etc.) or contain in its main chain a hetero atom (e.g., an oxygen atom, a sulfur atom, a nitrogen atom, etc.); higher fatty acid vinyl esters; alkyl vinyl ethers; olefins, e.g., butadiene, isoprene, diisobutylene, etc.; and the like. Copolymers obtained by copolymerizing a monomer whose polymer is soluble in the above-recited non-aqueous solvents with one or more comonomers hereinafter described at such a copolymerization ratio that the resulting copolymer may be soluble in the above-recited non-aqueous solvents can also be used. Specific examples of such comonomers are vinyl acetate, allyl acetate, a methyl, ethyl or propyl ester of acrylic acid, methacrylic acid, crotonic acid, maleic acid or itaconic acid, a styrene derivative (e.g., styrene, vinyltoluene, α-methylstyrene, etc.), an unsaturated carboxylic acid (e.g., acrylic acid, methacrylic acid, crotonic acid, maleic acid, itaconic acid, etc.) or an anhydride thereof, and monomers having various polar groups (e.g., a hydroxyl group, an amino group, an amido group, a cyano group, a sulfo group, a carbonyl group, a halogen atom, a heterocyclic ring, etc.), such as hydroxyethyl methacrylate, hydroxyethyl acrylate, diethylaminoethyl methacrylate, N-vinyl-pyrrolidone, acrylamide, acrylonitrile, 2-chloroethyl methacrylate, 2,2,2-trifluoroethyl methacrylate, etc.

In addition to the above-described synthetic resins, natural resins, such as alkyd resins, various fatty acid-modified alkyd resins, linseed oil, modified polyurethane resins, etc., may also be used as dispersion stabilizers.

Monomers for preparing non-aqueous dispersion resins according to the present invention comprise (A) a monofunctional monomer which is soluble in the non-aqueous solvent but is solidified by polymerization and (B) a monomer represented by formula (I) which contains at least two polar groups and/or polar linking groups and is copolymerizable with the monomer (A).

Examples of the monomer (A) include vinyl esters or allyl esters of aliphatic carboxylic acids having from 1 to 6 carbon atoms (e.g., acetic acid, propionic acid, butyric acid, monochloroacetic acid, etc.); alkyl esters or alkyl amides having from 1 to 3 carbon atoms in their alkyl moiety of unsaturated carboxylic acids (e.g., acrylic acid, methacrylic acid, crotonic acid, itaconic acid, maleic acid, etc.); styrene derivatives (e.g., styrene, vinyltoluene, α-methylstyrene, etc.); unsaturated carboxylic acids (e.g., acrylic acid, methacrylic acid, crotonic acid, maleic acid, itaconic acid, etc.) or anhydrides thereof; hydroxyethyl methacrylate, hydroxyethyl acrylate, methoxyethyl methacrylate, ethoxyethyl acrylate, diethylaminoethyl methacrylate, trimethoxysilylpropyl methacrylate, N-vinylpyrrolidone, acrylonitrile, and the like.

In formula (I) for the monomer (B), V preferably represents —O—,

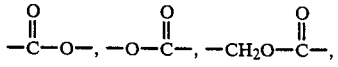

—CONH— or

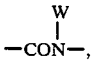

wherein W preferably represents a substituted or unsubstituted alkyl group having from 1 to 16 total carbon atoms, a substituted or unsubstituted alkenyl group having from 2 to 16 total carbon atoms, a substituted or unsubstituted alicyclic group having from 5 to 18 total carbon atoms, or $\text{+}R_1\text{-}X_1\text{+}_m\text{+}R_2\text{-}X_2\text{+}_n Y$; Y preferably represents a hydrogen atom, or an aliphatic group (e.g., an alkyl group, an alkenyl group, or an aralkyl group) having from 1 to 16 carbon atoms, which may be substituted with a halogen atom (e.g., a chlorine atom, a bromine atom, etc.), —OH, —CN, or —COOH; $X_1$ and $X_2$ (which may be the same or different) each preferably represents —O—, —S—, —CO—,

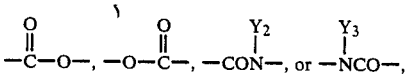

wherein $Y_2$ and $Y_3$ each has the same meaning as Y; $R_1$ and $R_2$ (which may be the same or different) each preferably represents a substituted or unsubstituted hydrocarbon residue (i.e., an alkyl group, an alkenyl group, an aralkyl group or an alicyclic group) having from 1 to 12 carbon atoms, which may contain a moiety of

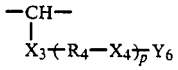

in its main chain, wherein $X_3$ and $X_4$ (which may be the same or different) each has the same meaning as $X_1$ and $X_2$; $R_4$ preferably represents a substituted or unsubstituted alkylene, alkenylene or aralkyl group having up to 12 carbon atoms; and $Y_6$ has the same meaning as Y; $a_1$ and $a_2$ (which may be the same or different) each preferably represents a hydrogen atom, a methyl group, —COOZ or —$CH_2$COOZ, wherein Z preferably represents a hydrogen atom, or an alkyl, alkenyl, aralkyl or cycloalkyl group having up to 18 carbon atoms; and m, n and p (which may be the same or different) each preferably represents 0 or an integer of from 1 to 3.

The more preferred are those of formula (I) wherein V represents —COO—, —CONH—, or

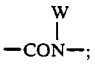

and $a_1$ and $a_2$ (which may be the same or different) each represents a hydrogen atom, a methyl group, —COOZ or —$CH_2$COOZ, wherein Z represents an alkyl group having from 1 to 12 carbon atoms.

More specifically, $R_1$ or $R_2$ is composed of an arbitrary combination of atomic groups, such as

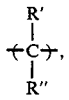

wherein R′ and R″ each represents a hydrogen atom, an alkyl group, a halogen atom, etc., +CH=CH+,

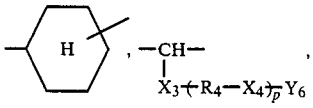

wherein $X_3$, $X_4$, $X_6$, $R_4$ and p are as defined above. Further, the total number of atoms constituting V, $R_1$, $X_1$, $R_2$, $X_2$, and Y is at least 8.

Specific examples of the monomer (B) represents by formula (I) are shown below:

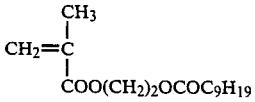

(1)

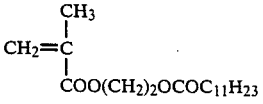

(2)

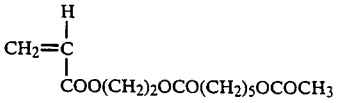

(3)

-continued (4)

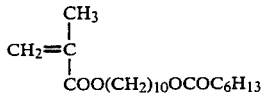

(5)

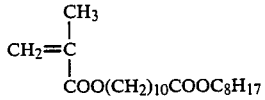

(6)

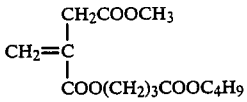

(7)

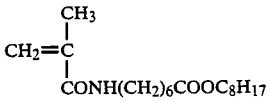

(8)

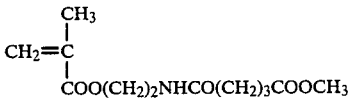

(9)

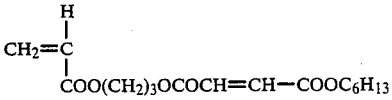

(10)

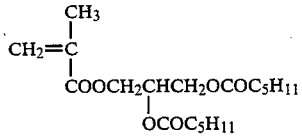

(11)

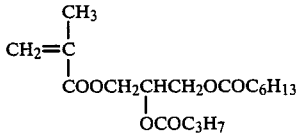

(12)

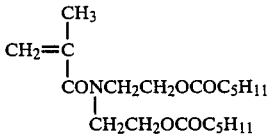

(13)

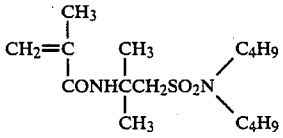

(14)

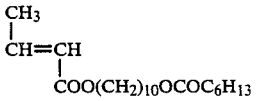

(15)

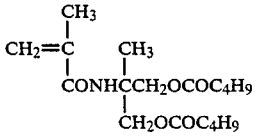

(16)

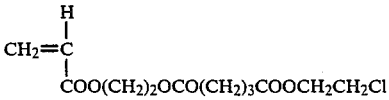

-continued (17)

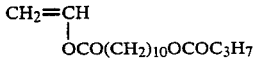

The dispersion resin in accordance with the present invention consists of at least one of the monomers (A) and at least one of the monomers (B). What is important is that the resin synthesized from these monomers would be a desired dispersion resin as long as it is insoluble in the above-described non-aqueous solvent.

Specific examples of the dispersion resins according to the present invention are shown below for illustrative purposes only but not for limitation:

(a)

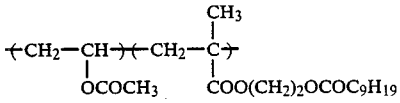

(b)

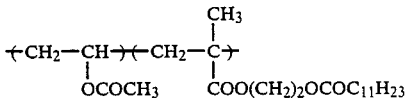

(c)

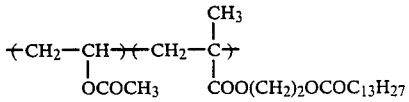

(d)

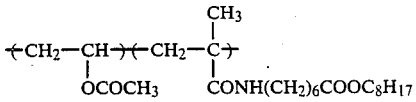

(e)

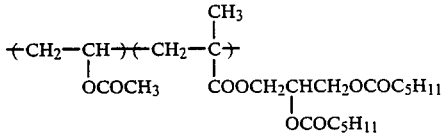

(f)

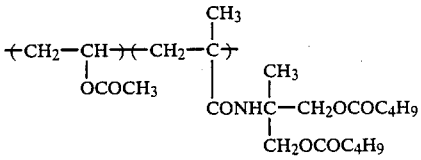

(g)

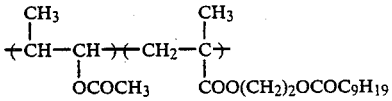

(h)

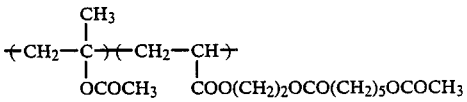

(i)

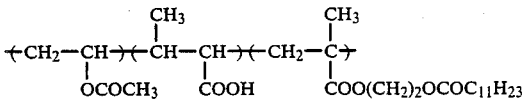

(j)

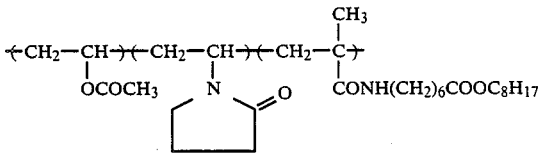

-continued

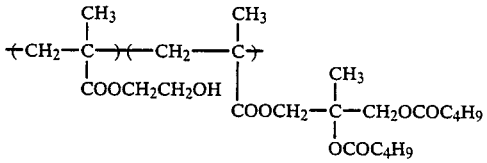

(k)

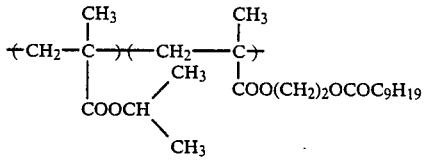

(l)

The dispersion resin to be used in this invention can be prepared usually by heating the resin for dispersion stability, the monomer (A), and the monomer (B) in a non-aqueous solvent in the presence of a polymerization initiator, such as benzoyl peroxide, azobisisobutyronitrile, butyl lithium, etc, to effect polymerization. In some detail, polymerization can be achieved by any of a method of adding a polymerization initiator to a mixed solution of the resin and the monomers (A) and (B); a method of adding dropwise the monomers (A) and (B) together with a polymerization initiator into a solution of the resin; a method of adding a part of a monomer mixture of monomers (A) and (B) together with a polymerization initiator to a mixed solution containing the whole quantity of the resin and the rest of the monomer mixture; a method of adding a mixed solution of the resin and monomers together with a polymerization initiator to a non-aqueous solution; and the like.

The monomer (B) is preferably used in an amount of from 0.05 to 30% by weight, and more preferably from 0.05 to 5% by weight, based on the monomer (A). The monomers (A) and (B) are used in a total amount of from about 5 to 80 parts by weight, and preferably from 10 to 50 parts by weight, per 100 parts by weight of the non-aqueous solvent. The dispersion resin of this invention has a molecular weight of from $10^3$ to $10^6$, and preferably from $10^4$ to $10^6$.

The soluble resin as a dispersion stabilizer is used in an amount of from 1 to 100 parts by weight, and preferably from 5 to 50 parts by weight, per 100 parts by weight of the total amount of monomers. The polymerization initiator is suitably used in an amount of from 0.1 to 5% by weight based on the total monomers.

The polymerization is carried out at a temperature of from about 50° to 180° C., and preferably from 60° to 120° C., for a preferred period of time of from 1 to 15 hours.

The thus obtained non-aqueous dispersion resins of the invention are fine particles having a uniform size distribution and exhibit very stable dispersibility. Even when they are repeatedly used in a developing apparatus for an extended period of time, satisfactory dispersibility can be maintained and also redispersion is easy so that no adhesion to the inside of the apparatus is observed. Further, when these particles are fixed upon heating, or the like means, a firm film can be formed, showing excellent fixing properties.

The compounds as monomers (A), such as methacrylates, acrylates, fatty acid vinyl esters, fatty acid acrylic esters, etc., that have also conventionally been used as monomers to be insolubilized by polymerization, contain an alkyl group usually having from 1 to 4 carbon atoms, or 6 at the most. When such monomers are polymerized, the produced resin undergoes solubilization in non-aqueous solvents, which leads to difficulty in particle formation or causes reduction in the softening point of the produced resin which thereby deteriorates preservability against thermal changes. In contrast, when the monomer (A) to be insolubilized is polymerized and granulated in the presence of the copolymerizable monomer (B) having at least two polar moieties in a small proportion, i.e., from 0.5 to 3% by weight based on the monomer (A), mono-dispersed resin particles having a desired mean particle size and exhibiting markedly improved redispersibility can be obtained without suffering solubilization or reduction in softening point below the lowest limit for practical use.

According to European Patent 155788A1, in which non-aqueous dispersion resin particles are produced by polymerizing a monomer to be insolubilized in the presence of a copolymerizable monomer having a long chain aklyl moiety, the resulting resin particles are excellent in dispersibility as described above. However, in cases when they are applied to printing on a large-sized printer using a large-sized master plate for offset printing or printing using an offset master plate manufactured by rapid processing, the number of prints obtained were as low as about 5,000 to 8,000, indicating poor printing durability.

To the contrary, use of the developer containing the resin particles obtained by the present invention makes it possible to produce more than 10,000 prints in both cases of printing on a large-sized printer using a large-sized master plate and cases of printing using a master plate prepared by a plate making machine for rapid processing.

From the above-described experimental facts, it is assumed that the soluble component contained in the monomer (B) is present on the interface of the insolubilized and dispersed resin particles to make some surface modification and that the thermal compatibility between the monomer (A) and the monomer (B) in the insoluble resin particles, is improved. The remarkable improvements on performance properties attained by the present invention are considered attributable to these assumptions.

If desired, a colorant may be used in the present invention. The colorants to be used are not particularly restricted and include various known pigments and dyes.

In cases where the dispersion resin per se is colored, one method for coloration comprises physically dispersing a pigment or dye in the dispersion resin. A number of pigments and dyes are known for this purpose, such as magnetic iron oxide powders, lead iodide powders, carbon black, Nigrosine, Alkali Blue, Hansa Yellow, Quinacridone Red, Phthalocyanine Blue, etc. Other methods for coloration include a method of dyeing the dispersion resin with a desired dye as described in Japanese Patent Application (OPI) No. 48738/82; a method of chemically binding the dispersion resin with a dye as disclosed in Japanese Patent Application (OPI) No. 54029/78; and a method in which a monomer previously containing a color former is used in the polymerization granulation to obtain a copolymer containing the color former as described in Japanese Patent Publication No. 22955/69.

For the purpose of enhancing charging characteristics or improving image forming properties, the liquid developer according to the present invention may contain, if desired, various additives as taught by, e.g., Yuji Harazaki, *Denshi Shasin* (Electrophotography), Vol. 16, No. 2, 44. For example, metal salts of di-2-ethylhexylsulfosuccinic acid, metal salts of naphthenic acid, metal salts of higher fatty acids, lecithin, polyvinylpyrrolidone, copolymers containing a maleic semiamide component, and the like can be used as charge controlling agents.

In the liquid developer according to the present invention, toner particles consisting mainly of the resin and the colorant are preferably present in an amount of from 0.5 to 50 parts by weight per 1,000 parts by weight of the carrier medium. Amounts less than 0.5 part result in insufficient image density, and amounts more than 50 parts readily cause fog on non-image areas. The resins soluble in the carrier medium, such as dispersion stabilizers, if any, are present in an amount of from 0.5 to 100 parts by weight per 1,000 parts by weight of the carrier medium. The above-described charge controlling agent is preferably used in an amount of from 0.001 to 1.0 part by weight per 1,000 parts by weight of the carrier medium.

The liquid developer of the invention may further contain other various additives according to necessity, with the total amount thereof being limited by electrical resistivity of the developer. More specifically, the amount of each additive should be controlled within such a range that the liquid developer from which toner particles have been removed may have an electrical resistivity more than $10^9$ Ω·cm, because if such electrical resistivity is not more than $10^9$ Ω·cm, it becomes difficult to obtain an image of satisfactory continuous gradation.

The present invention will now be illustrated with reference to Preparation Examples and Examples, but it should be understood that these examples are not deemed to limit the present invention.

PREPARATION EXAMPLE 1

Preparation of Dispersion Resin (a)

A mixed solution consisting of 12 g of polylauryl methacrylate, 100 g of vinyl acetate, 0.5 g of Monomer (1) as the monomer (B), and 385 g of isododecane was heated to 70° C. in a nitrogen stream while stirring. To the mixture was added 1.7 g of 2,2'-azobis(isobutyronitrile) (AIBN), followed by allowing the mixture to react for 6 hours. After 30 minutes from the polymerization initiation, the homogeneous solution became turbid, and the reaction temperature rose to 85° C. After cooling, the reaction mixture was filtered through nylon cloth of 200 mesh to obtain a white latex having a degree of polymerization of 85% and a mean particle size of 0.20 μm.

PREPARATION EXAMPLE 2

Preparation of Dispersion Resin (b)

Polymerization was carried out in the same manner as in Preparation Example 1, except for replacing Monomer (1) with Monomer (2). After 40 minutes from the polymerization initiation, the homogeneous solution became white turbid, and the reaction temperature rose to 85° C. After cooling, the reaction mixture was worked-up in the same manner as in Preparation Example 1 to obtain a white latex having a degree of polymerization of 88% and a mean particle size of 0.23 μm.

PREPARATION EXAMPLE 3

Preparation of Dispersion Resin (e)

Polymerization was carried out in the same manner as in Preparation Example 1, except for replacing Monomer (1) with Monomer (10), replacing isododecane with 380 g of Isopar G, and heating to a temperature of 75° C. After 20 minutes from the polymerization initiation, the solution became white turbid, and the reaction temperature rose to 88° C. The reaction mixture was worked-up in the same manner as in Preparation Example 1 to obtain a white latex having a degree of polymerization of 90% and a mean particle size of 0.22 μm.

PREPARATION EXAMPLE 4

Preparation of Dispersion Resin (b)

A mixed solution of 14 g of polystearyl methacrylate and 380 g of Shellsol 71 was heated to 75° C. in a nitrogen stream white stirring. A mixed solution consisting of 100 g of vinyl acetate, 1.0 g of Monomer (2), and 1.7 g of AIBN was added dropwise to the heated solution over a period of 2 hours, and the stirring was further continued for additional 4 hours. After cooling, the reaction mixture was filtered through nylon cloth of 200 mesh to obtain a white latex having a degree of polymerization of 85% and a mean particle size of 0.23 μm.

PREPARATION EXAMPLE 5

Preparation of Dispersion Resin (f)

A mixed solution consisting of 15 g of a lauryl methacrylate/acrylic acid copolymer (9/1 by mol), 100 g of vinyl acetate, 1.3 g of Monomer (15), and 380 g of Isopar G was heated to 75° C. in a nitrogen stream while stirring. To the solution was added 1.5 g of benzoyl peroxide, followed by allowing the mixture to react for 6 hours. After 10 minutes from the polymerization initiation, the solution became white turbid, and the reaction temperature rose to 90° C. The reaction temperature was then raised to 100° C., at which the mixture was stirred for 1 hour to distill off any remaining vinyl acetate. After cooling, the reaction mixture was passed through nylon cloth of 200 mesh to obtain a white latex having a degree of polymerization of 90% and a mean particle size of 0.17 μm.

PREPARATION EXAMPLE 6

Preparation of Dispersion Resin (i)

The same procedure as in Preparation Example 5 was repeated, except for starting with a mixed solution consisting of 4 g of polylauryl methacrylate, 100 g of vinyl acetate, 5 g of crotonic acid, 1.0 g of Monomer (2), and 468 g of Isopar E. The resulting white latex had a degree of polymerization of 85% and a mean particle size of 0.18 μm.

PREPARATION EXAMPLE 7

Preparation of Dispersion Resin (l)

A mixed solution consisting of 20 g of polylauryl methacrylate, 100 g of isopropyl methacrylate, 2 g of Monomer (1), and 470 g of n-decane was heated to 70° C. in a nitrogen stream while stirring. To the heated solution was added 1.7 g of AIBN, followed by allowing the mixture to react for 4 hours. To the reaction mixture was further added 0.5 g of AIBN, and the reaction was continued for an additional two hours. After cooling, the reaction mixture was passed through nylon cloth of 200 mesh to obtain a white latex having a mean particle size of 0.20 μm.

COMPARATIVE PREPARATION EXAMPLE 1

The same procedure as in Preparation Example 1 was repeated, except that Monomer (1) as the monomer (B) was not used. The resulting white latex had a degree of polymerization of 85% and a mean particle size of 0.2 μm.

COMPARATIVE PREPARATION EXAMPLE 2

The same procedure as in Preparation Example 1 was repeated, except for starting with a mixed solution consisting of 15 g of polylauryl methacrylate, 100 g of vinyl acetate, 3 of lauryl methacrylate, and 385 g of isodecane. The resulting white latex had a degree of polymerization of 85% and a mean particle size of 0.20 μm.

EXAMPLE 1

Ten grams of polylauryl methacrylate, 10 g of Nigrosine, 30 g of Shellsol 71, and glass beads were placed in a paint shaker (manufactured by Tokyo Seiki K.K.), and the content was shaked for 90 minutes to obtain a fine dispersion of Nigrosine.

The above obtained Nigrosine dispersion (2.5 g), 30 g of the resin dispersion as prepared in Preparation Example 1, and 0.05 g of an octadecenemaleic semioctadecylamide copolymer were diluted with 1 liter of Shellsol 71 to prepare Liquid Developer A for electrostatic photography.

For comparison, Liquid Developers B and C were prepared in the same manner as for Developer A, except for using the resin dispersions obtained in Comparative Preparation Examples 1 and 2, respectively, in place of that of Preparation Example 1.

An electrophotographic light-sensitive material, ELP Master II type (made by Fuji Photo Film Co., Ltd.) was exposed to light and developed by means of an automatic plate making machine, ELP 404V (manufactured by Fuji Photo Film Co., Ltd.), using each of Liquid Developers A to C. Subsequently, ELP Master II type was further processed 2,000 times, and adhesion of the toner onto the developing apparatus was observed. The results obtained are shown in Table 1 below.

TABLE 1

| Liquid Developer | Adhesion onto Developing Apparatus | Image Quality of the 2000th Plate |
|---|---|---|
| A | not observed | clear |
| B | observed | disappearance of letters, blur of solid areas, and fog on non-image areas |
| C | not observed | clear |

The master plate for offset printing (ELP Master) which was obtained by using Liquid Developer A or C was used for printing in the usual manner until disappearance of letters, blur of solid areas, and the like occurred on the resulting image. As a result, the offset master obtained by using Liquid Developer A according to the present invention did not cause any of these faults on the 10,000th print or even further prints, whereas these faults occurred on the 8,000th print in the case of the master plate obtained by using Liquid Developer C.

In view of the above results combined with the results of Table 1, Liquid Developer B causes contamination of the developing apparatus, and Liquid Developer C was insufficient in printing durability upon printing, though causing no contamination of the developing apparatus. In other words, only the developer using the resin particles of the present invention achieves a marked improvement in printing durability of master plates without causing any contamination of a developing apparatus. These results obviously prove the superiority of the resin particles according to the present invention.

EXAMPLE 2

A mixture of 10 g of the resin dispersion as prepared in Preparation Example 1 and 1.5 g of Sumikaron Black (produced by Sumitomo Chemical Co., Ltd.) was heated to 100° C. for 4 hours while stirring. After cooling to room temperature, any remaining dye was removed by passing the mixture through nylon cloth of 200 mesh to thereby obtain a black resin dispersion having a mean particle size of 0.20 μm.

The resulting black resin dispersion (32 g) and 0.05 g of zirconium naphthenate were diluted with 1 liter of Shellsol 71 to prepare a liquid developer.

When development was carried out using the resulting developer in the same manner as described in Example 1 to obtain 2,000 prints, no contamination of the apparatus due to adhesion of toners was observed. Further, the resulting master plate for offset printing had a clear image, and the image of the print after printing 10,000 sheets was also very clear.

EXAMPLE 3

A mixture of 10 g of the white dispersion as prepared in Preparation Example 6 and 3 g of Victoria Blue B was heated at 70° to 80° C. for 6 hours with stirring. After cooling to room temperature, the mixture was filtered through nylon cloth of 200 mesh to remove any remaining dye to thereby obtain a blue resin dispersion having a mean particle size of 0.18 m.

The thus prepared blue dispersion (32 g) and 0.05 g of zirconium naphthenate were diluted with 1 liter of Isopar H to prepare a liquid developer.

When development was carried out using the resulting developer in the same manner as described in Example 1 to obtain 2,000 prints, no contamination of the apparatus due to adhesion of toners was observed. Further, the resulting master plate for offset printing had a clear image, and the image of the print after printing 10,000 sheets was also very good.

EXAMPLE 4

The white resin dispersion prepared in Preparation Example 2 (32 g), 2.5 g of the Nigrosine dispersion as prepared in Example 1, and 0.02 g of a semidocosanylamide of a diisobutylene/maleic anhydride copolymer were diluted with 1 liter of Isopar G to prepare a liquid developer.

When development of 2,000 sheets was carried out by using the resulting developer in the same manner as in Example 1, no contamination of the apparatus due to adhesion of toners was observed. Further, both the image of the resulting master plate for offset printing and the image of the print after printing 10,000 sheets were clear.

When the liquid developer as above prepared was allowed to stand for 3 months and then subjected to development processing in the same manner as above, the results observed were equal to those obtained with the developer immediately after the preparation.

EXAMPLE 5

Ten grams of polydecyl methacrylate, 30 g of Isopar H, and 8 g of Alkali Blue were placed in a paint shaker together with glass beads, and the content was shaked for 2 hours to obtain a fine dispersion of Alkali Blue.

The resulting Alakli Blue dispersion (4.2 g), 30 g of the white resin dispersion as prepared in Preparation Example 3, and 0.02 g of a semidocosanylamide of a diisobutylene/maleic anhydride copolymer were diluted with 1 liter of Isopar G to prepare a liquid developer.

When development was carried out using the resulting liquid developer in the same manner as described in Example 1, no contamination of the apparatus due to adhesion of toners was observed even after 2,000 sheets were developed. Further, both the image of the resulting master plate for offset printing and the image of the print after printing 10,000 sheets were also very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising a non-aqueous solvent having electrical resistivity of not less than $10^9\Omega\cdot$cm and a dielectric constant of not more than 3.5 having dispersed therein at least one resin, wherein said resin is a copolymer resin obtained by subjecting a solution containing (A) at least one of monofunctional monomer which is soluble in said solvent but insolubilized upon polymerization and (B) at least one of monomers having at least two polar groups and/or polar linking groups represented by formula (I):

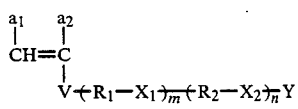

(I)

wherein V represents —O—,

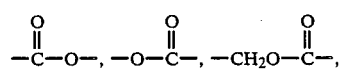

—$SO_2$—, —CONH—, —$SO_2$NH—,

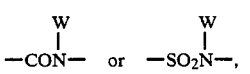

wherein W represents a hydrocarbon residue or $\text{-}(R_1\text{-}X_1)_m\text{-}(R_2\text{-}X_2)_n\text{-}Y$; Y represents a hydrogen atom, a hydrocarbon residue having from 1 to 18 carbon atoms, or a hydrocarbon residue having from 1 to 18 carbon atoms which is substituted with a halogen atom, —OH, —CN, —$NH_2$, —COOH, —$SO_3H$ or $PO_3H$; $X_1$ and $X_2$ each represents —O—, —S—, —CO—, —$CO_2$—,

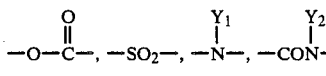

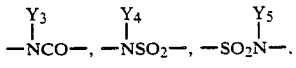

—$NHCO_2$—or —NHCONH—, wherein $Y_1$, $Y_2$, $Y_3$, $Y_4$ and $Y_5$ each has the same meaning as Y; $R_1$ and $R_2$ each represents a substituted or unsubstituted hydrocarbon residue having from 1 to 18 carbon atoms which may contain a moiety of

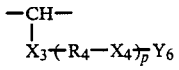

in its main chain, wherein $X_3$ and $X_4$ each has the same meaning as $X_1$ and $X_2$; $R_4$ represents a substituted or unsubstituted hydrocarbon residue having from 1 to 18 carbon atoms; and $Y_6$ has the same meaning as Y; $a_1$ and $a_2$ each represents a hydrogen atom, a hydrocarbon residue, —COOZ or —COOZ having a hydrocarbon residue attached at the carbonyl, wherein Z represents a hydrogen atom or a substituted or unsubstituted hydrocarbon residue; and m, n and p each represents O or an integer of from 1 to 4, to a polymerization reaction in the presence of a resin which is soluble in said solvent and contains no graft group polymerizable with said monomers, and wherein said at least one of monofunctional monomer which is soluble in said solvent but insolubilized upon polymerization and said at least one monomer having at least two polar groups and/or polar linking groups from particles and said particles have absorbed to the surface thereof as an outer particle resin said resin which contains no graft group polymerizable with said monomers.

2. A liquid developer as in claim 1, wherein V represents —O—,

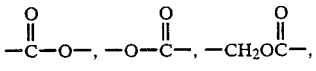

—CONH—, or

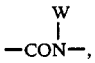

wherein W represents a substituted or unsubstituted alkyl group having from 1 to 16 total carbon atoms, a substituted or unsubstituted alkenyl group having from 2 to 16 total carbon atoms, a substituted or unsubstituted alicyclic group having from 5 to 18 total carbon atoms, or $\text{-}(R_1\text{-}X_1)_m\text{-}(R_2\text{-}X_2)_n\text{-}Y$; Y represents a hydrogen atom, an aliphatic group having from 1 to 16 total carbon atoms, or an aliphatic group having from 1 to 16 total carbon atoms which is substituted with a halogen atom, —OH, —CN, or —COOH; $X_1$ and $X_2$ each represents —O—, —S—, —CO—,

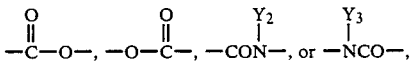

wherein $Y_2$ and $Y_3$ each has the same meaning as Y; $R_1$ and $R_2$ each represents a substituted or unsubstituted hydrocarbon residue having from 1 to 12 carbon atoms, which may contain a moiety of $$-\underset{\displaystyle X_3\!\left(\!R_4-X_4\right)_p Y_6}{\underset{|}{CH}}-$$

in its main chain, wherein $X_3$ and $X_4$ each has the same meaning as $X_1$ and $X_2$; $R_4$ represents a substituted or unsubstituted alkylene, alkenylene or aralkyl group having up to 12 carbon atoms; and $Y_6$ has the same meaning as Y; $a_1$ and $a_2$ each represents a hydrogen atom, a methyl group, —COOZ or —$CH_2COOZ$, wherein Z represents a hydrogen atom, or an alkyl, alkenyl, aralkyl or cycloalkyl group having up to 18 carbon atoms; and m, n and p each represents O or an integer of from 1 to 3.

3. A liquid developer as in claim 1, wherein the total number of atoms constituting V, $R_1$, $X_1$, $R_2$, $X_2$, and Y is at least 8.

4. A liquid developer as in claim 1, wherein the monomer (B) is present in an amount of from 0.05 to 30% by weight based on the monomer (A).

5. A liquid developer as in claim 4, wherein the monomer (B) is present in an amount of from 0.05 to 5% by weight based on the monomer (A).

6. A liquid developer as in claim 1, wherein the monomers (A) and (B) are present in a total amount of from 5 to 80 parts by weight per 100 parts by weight of said non-aqueous solvent.

7. A liquid developer as in claim 6, wherein the monomers (A) and (B) are present in a total amount of from 10 to 50 parts by weight per 100 parts by weight of said non-aqueous solvent.

8. A liquid developer as in claim 1, wherein said soluble resin is used in an amount of from 1 to 100 parts by weight per 100 parts by weight of the sum of the monomers (A) and (B).

9. A liquid developer for electrostatic photography as claimed in claim 1, wherein at least one of m and n represents an integer of 1 to 3.

10. A liquid developer for electrostatic photography as claimed in claim 1, wherein Y represents a hydrocarbon residue having from 1 to 18 carbon atoms or a hydrocarbon residue having 1 to 18 carbon atoms which is substituted with a halogen atom or —CN.

11. A liquid developer for electrostatic photography as claimed in claim 9, wherein Y represents a hydrocarbon residue having from 1 to 18 carbon atoms or a hydrocarbon residue having 1 to 18 carbon atoms which is substituted with a halogen atom or —CN.

12. A liquid developer for electrostatic photography as claimed in claim 11, wherein the monomer (B) is present in an amount of from 0.05 to 5% by weight based on the monomer (A).

13. A method of preparing a liquid developer for electrostatic photography comprising a non-aqueous solvent having electrical resistivity of not less than $10^9$ Ω·cm and a dielectric constant of not more than 3.5 having dispersed therein at least one resin, which method comprises subjecting a solution containing (A) at least one of monofunctional monomer which is soluble in said solvent but insolubilized upon polymerization and (B) at least one of monomers having at least two polar groups and/or polar linking groups represented by formula (I):

$$\overset{a_1}{\underset{|}{CH}}=\overset{a_2}{\underset{|}{C}}-\underset{\displaystyle V\!\left(\!R_1-X_1\right)_m\!\left(\!R_2-X_2\right)_n Y}{\underset{|}{}} \qquad (I)$$

wherein V represents —O—, $$-\overset{O}{\overset{\|}{C}}-O-,\ -O-\overset{O}{\overset{\|}{C}}-,\ -CH_2O-\overset{O}{\overset{\|}{C}}-,$$

$-SO_2-$, —CONH—, $-SO_2NH-$, $$-\overset{W}{\overset{|}{CON}}-\ \text{or}\ -\overset{W}{\overset{|}{SO_2N}}-,$$

wherein W represents a hydrocarbon residue or $\!\left(\!R_1-X_1\right)_m\!\left(\!R_2-X_2\right)_n-Y$; Y represents a hydrocarbon residue having from 1 to 18 carbon atoms, or a hydrocarbon residue having from 1 to 18 carbon atoms which is substituted with a halogen atom, —OH, [—CH] —CN, $-NH_2$, —COOH, $-SO_3H$ or $PO_3H$; $X_1$ and $X_2$ each represents —O—, —S—, —CO—, $-CO_2-$, $$-O-\overset{O}{\overset{\|}{C}}-,\ -SO_2-,\ -\overset{Y_1}{\overset{|}{N}}-,\ -\overset{Y_2}{\overset{|}{CON}}-,$$

$$-\overset{Y_3}{\overset{|}{NCO}}-,\ -\overset{Y_4}{\overset{|}{NSO_2}}-,\ -\overset{Y_5}{\overset{|}{SO_2N}}-,$$

$-NHCO_2-$or —NHCONH—, wherein $Y_1$, $Y_2$, $Y_3$, $Y_4$ and $Y_5$ each has the same meaning as Y; $R_1$ and $R_2$ each represents a substituted or unsubstituted hydrocarbon residue having from 1 to 18 carbon atoms which may contain a moiety of $$-\underset{\displaystyle X_3\!\left(\!R_4-X_4\right)_p Y_6}{\underset{|}{CH}}-$$

in its main chain, wherein $X_3$ and $X_4$ each has the same meaning as $X_1$ and $X_2$; $R_4$ represents a substituted or unsubstituted hydrocarbon residue having from 1 to 18 carbon atoms; and $Y_6$ has the same meaning as Y; $a_1$ and $a_2$ each represents a hydrogen atom, a hydrocarbon residue, —COOZ or —COOZ having a hydrocarbon residue attached at the carbonyl, wherein Z represents a hydrogen atom or a substituted or unsubstituted hydrocarbon residue; and m, n and p each represents O or an integer of from 1 to 4, to a polymerization reaction in the presence of a resin which is soluble in said solvent and contains no graft group polymerizable with said monomers, and wherein said at least one of monofunctional monomer which is soluble in said solvent but insolubilized upon polymerization and said at least one monomer having at least two polar groups and/or polar linking groups from particles and said particles have absorbed to the surface thereof as an outer particle resin said resin which contains no graft group polymerizable with said monomers.

* * * * *